US010918903B2

(12) United States Patent
Burkhardt

(10) Patent No.: US 10,918,903 B2
(45) Date of Patent: Feb. 16, 2021

(54) SLANT BOARD EXERCISE MACHINE

(71) Applicant: Matthew Boyd Burkhardt, East Norwich, NY (US)

(72) Inventor: Matthew Boyd Burkhardt, East Norwich, NY (US)

( * ) Notice: Subject to any disclaimer, the term of this patent is extended or adjusted under 35 U.S.C. 154(b) by 41 days.

(21) Appl. No.: 15/950,703

(22) Filed: Apr. 11, 2018

(65) Prior Publication Data

US 2018/0229073 A1 Aug. 16, 2018

Related U.S. Application Data

(63) Continuation-in-part of application No. 15/633,933, filed on Jun. 27, 2017, now Pat. No. 10,625,112, which is a continuation-in-part of application No. 15/273,174, filed on Sep. 22, 2016, now Pat. No. 10,357,682.

(60) Provisional application No. 62/336,844, filed on May 16, 2016.

(51) Int. Cl.

| | |
|---|---|
| ***A63B 21/00*** | (2006.01) |
| ***A63B 23/035*** | (2006.01) |
| ***A63B 22/20*** | (2006.01) |
| ***A63B 21/06*** | (2006.01) |
| ***A63B 21/068*** | (2006.01) |
| ***A63B 21/22*** | (2006.01) |
| *A63B 71/00* | (2006.01) |

(52) U.S. Cl.

CPC ..... *A63B 21/4047* (2015.10); *A63B 21/0616* (2015.10); *A63B 21/159* (2013.01); *A63B 21/4049* (2015.10); *A63B 22/203* (2013.01); *A63B 23/03525* (2013.01); *A63B 21/00069* (2013.01); *A63B 21/068* (2013.01); *A63B 21/22* (2013.01); *A63B 21/4015* (2015.10); *A63B 21/4035* (2015.10); *A63B 21/4045* (2015.10); *A63B 22/208* (2013.01); *A63B 23/0355* (2013.01); *A63B 2071/0072* (2013.01)

(58) Field of Classification Search

CPC .. A63B 21/4047; A63B 21/4011–4015; A63B 23/08; A63B 23/085; A63B 22/20–208; A63B 22/0087; A63B 22/0067; A63B 22/14–18; A63B 22/0056; A63B 26/00; A63B 26/003; A63B 2026/006

USPC ..... 472/112

See application file for complete search history.

(56) References Cited

U.S. PATENT DOCUMENTS

| | | | | | |
|---|---|---|---|---|---|
| 2,764,411 | A * | 9/1956 | Washburn, Jr. | A63B 22/16 | 482/146 |
| 3,421,760 | A * | 1/1969 | Freeman, Jr. | A63B 21/04 | 482/80 |
| 3,525,522 | A * | 8/1970 | Piller | A63B 22/16 | 482/80 |
| 3,559,986 | A * | 2/1971 | Ehrmantraut | A63B 23/03533 | 482/70 |
| 4,505,477 | A * | 3/1985 | Wilkinson | A63B 22/16 | 280/87.041 |

(Continued)

*Primary Examiner* — Nyca T Nguyen

(74) *Attorney, Agent, or Firm* — Dunlap Bennett & Ludwig, PLLC; Brendan E. Squire

(57) ABSTRACT

An exercise machine that enables a user to exercise extensor and flexor muscles. The exercise machine includes a base with a rolling cylinder configured to roll from a front end of the base to a rear end of the base. The exercise machine further includes a slant board resting on the rolling cylinder.

15 Claims, 9 Drawing Sheets

(56) References Cited

U.S. PATENT DOCUMENTS 4,694,684 A * 9/1987 Campbell, III ..... A63C 11/26 280/809
5,106,081 A * 4/1992 Webb ..... A63B 21/155 482/100
5,299,997 A * 4/1994 Chen ..... A63B 21/068 482/72
5,360,383 A * 11/1994 Boren ..... A63B 23/0244 482/10
5,362,297 A * 11/1994 Muir ..... A63B 21/023 482/112
5,399,140 A * 3/1995 Klippel ..... A63B 22/18 482/123
5,441,454 A * 8/1995 Race ..... A63G 3/00 114/363
5,447,480 A * 9/1995 Fulks ..... A63B 21/00072 482/100
5,582,567 A * 12/1996 Chang ..... A63B 22/16 482/132
5,702,328 A * 12/1997 Mansvelt ..... A63B 21/068 482/96
5,711,749 A * 1/1998 Miller ..... A63B 23/0222 482/111
5,755,651 A * 5/1998 Homyonfer ..... A63B 22/16 482/123
5,851,166 A * 12/1998 Bernardson ..... A63B 22/16 482/79
5,891,002 A * 4/1999 Maki ..... A63B 22/16 482/146
6,264,588 B1 * 7/2001 Ellis ..... A63B 21/068 482/100
6,287,241 B1 * 9/2001 Ellis ..... A63B 21/06 482/100
6,312,365 B1 * 11/2001 Koenig ..... A63B 21/0615 482/93
6,916,278 B2 * 7/2005 Webber ..... A63B 21/068 482/72
7,052,444 B2 * 5/2006 Webber ..... A63B 21/068 482/100
7,374,522 B2 * 5/2008 Arnold ..... A63B 21/005 482/146
8,057,362 B2 * 11/2011 Nadim ..... A63B 22/0017 482/146
9,162,099 B2 * 10/2015 Burkhardt ..... A63B 21/4034
9,345,927 B2 * 5/2016 Chang ..... A61H 1/0266
9,630,041 B2 * 4/2017 Ellis ..... A63B 21/159
2003/0073550 A1 * 4/2003 Hsu ..... A61H 1/005 482/142
2003/0225348 A1 * 12/2003 Chen ..... A61H 1/005 601/28
2007/0232464 A1 * 10/2007 Chu ..... A63B 21/00072 482/96
2008/0161175 A1 * 7/2008 Ho ..... A63B 22/14 482/146
2009/0082181 A1 * 3/2009 Salvioli ..... A63B 21/159 482/114
2009/0176625 A1 * 7/2009 Giannelli ..... A63B 22/001 482/52
2009/0312678 A1 * 12/2009 Huang ..... A61H 7/003 601/87
2011/0263398 A1 * 10/2011 Klassen ..... A63B 22/16 482/146
2012/0108406 A1 * 5/2012 Jeong ..... A63B 21/159 482/146
2013/0331238 A1 * 12/2013 Ellis ..... A63B 21/159 482/97
2014/0121070 A1 * 5/2014 Ellis ..... A63B 21/159 482/96
2014/0206512 A1 * 7/2014 Burkhardt ..... A63B 21/4034 482/145
2014/0243163 A1 * 8/2014 Edmondson ..... A63B 22/0076 482/72
2015/0119204 A1 * 4/2015 Loane ..... A63B 22/203 482/71
2015/0328497 A1 * 11/2015 Doucot ..... A63B 23/08 482/146
2015/0367173 A1 * 12/2015 Ellis ..... A63B 21/4047 482/127
2016/0296791 A1 * 10/2016 Bailar ..... A63B 23/0494
2016/0346586 A1 * 12/2016 Pullins ..... A63B 21/0615
2017/0106235 A1 * 4/2017 Carter ..... A63B 21/4035
2017/0113094 A1 * 4/2017 Bailar ..... A63B 22/203
2017/0252605 A1 * 9/2017 Siqueira ..... A63B 22/201
2018/0015322 A1 * 1/2018 Carr ..... A63B 22/203

* cited by examiner

SLANT BOARD EXERCISE MACHINE

CROSS-REFERENCE TO RELATED APPLICATION

This application is a continuation in part of U.S. non-provisional application Ser. No. 15/633,933 filed Jun. 27, 2017, which is a continuation in part of Ser. No. 15/273,174, filed Sep. 22, 2016, which claims the benefit of priority of U.S. provisional application No. 62/336,844, filed May 16, 2016 the contents of which are herein incorporated by reference.

BACKGROUND OF THE INVENTION

The present invention relates to an exercise machine and, more particularly, to an exercise machine that exercises extensor and flexor muscles.

Currently, exercise machines generally fail to enable users to exercise both the extensor and flexor muscles. In order to exercise both extensor and flexor muscles, a user may have to use two separate machines. However, some machines that do allow a user to exercise the extensor and flexor muscles are extremely expensive.

As can be seen, there is a need for a less expensive machine that exercises the extensor and flexor muscles.

SUMMARY OF THE INVENTION

In one aspect of the present invention, an exercise machine comprises: a base comprising upright walls spaced apart from one another, and tracks formed along inner surfaces of the upright walls from a front end of the base to a rear end of the base; a fulcrum comprising a frame and a rotating cylinder rotatably disposed within the frame, wherein guide bearings extend from opposing sides of the frame and are slidably disposed within the tracks; a slant board disposed substantially above the base and resting on the rotating cylinder; and a seat support extending vertically from the base and comprising a seat.

In another aspect of the present invention, an exercise machine comprises: a base comprising a front end, a rear end, and upright walls; a rotating cylinder rotatably disposed on the upright walls and operable to rotate from the rear end of the base to the front end of the base and from the front end of the base to the rear end of the base; a slant board disposed substantially above the base and resting on the rotating cylinder, the slant board comprising a horizontal back portion, a vertical middle portion, and a horizontal front portion; and a seat support extending vertically from the base and comprising a seat.

These and other features, aspects and advantages of the present invention will become better understood with reference to the following drawings, description and claims.

DETAILED DESCRIPTION OF THE INVENTION

Figure 1:
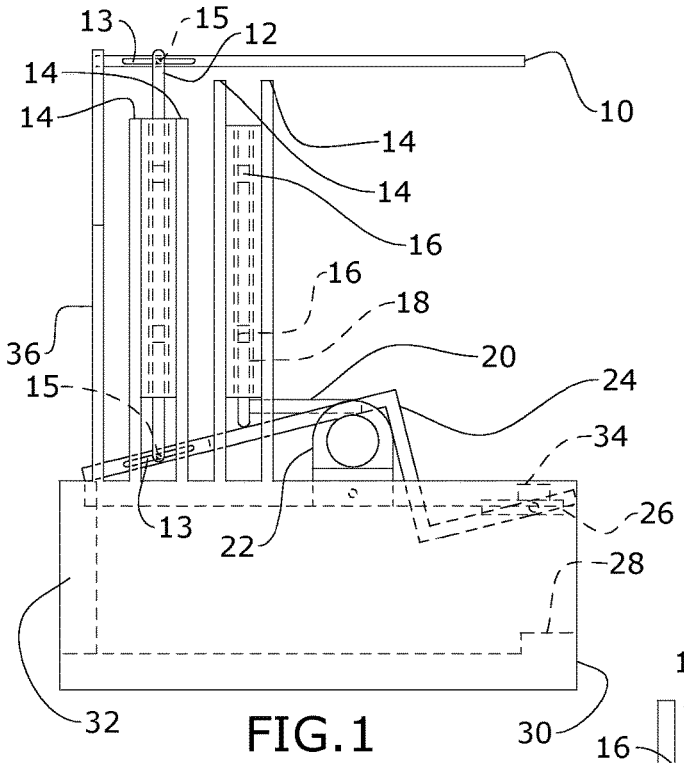
FIG. 1 is a side view of an embodiment of the present invention.
Figure 2:
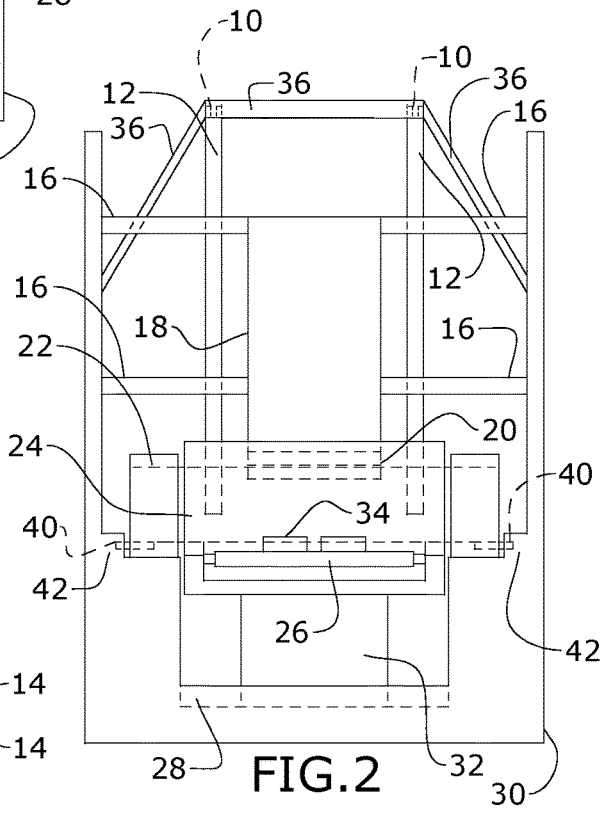
FIG. 2 is a front view of an embodiment of the present invention.
Figure 3:
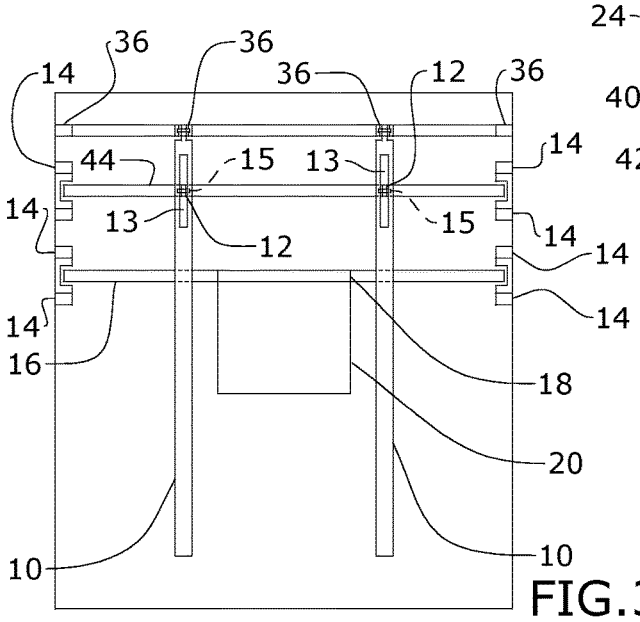
FIG. 3 is a top view of an embodiment of the present invention.
Figure 4:
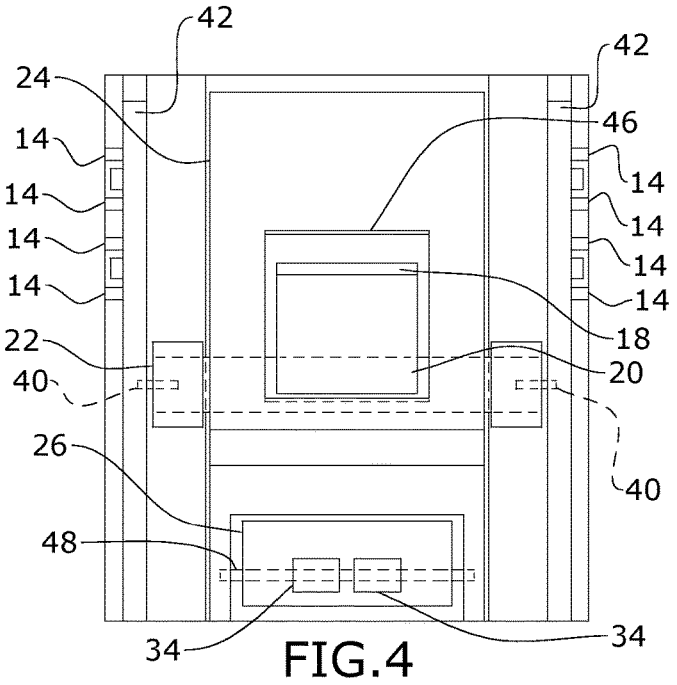
FIG. 4 is a top view of an embodiment of the present invention.
Figure 5:
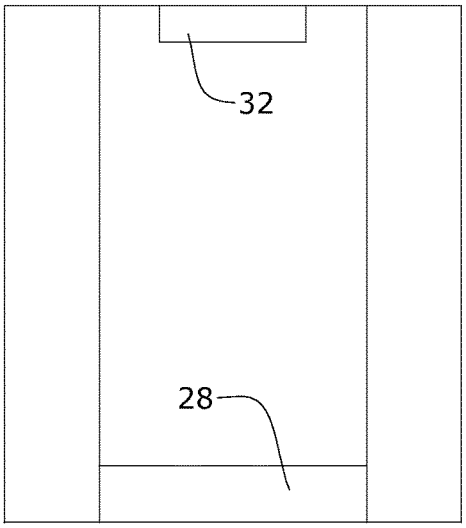
FIG. 5 is a top view of an embodiment of the present invention.
Figure 6:
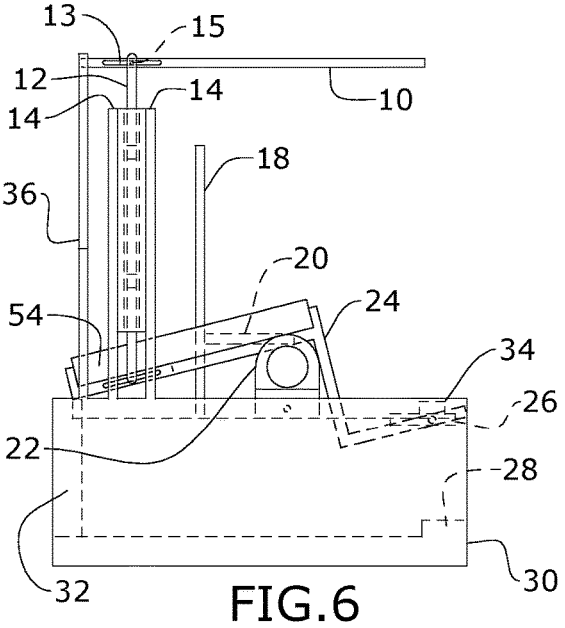
FIG. 6 is a side view of an embodiment of the present invention.
Figure 7:
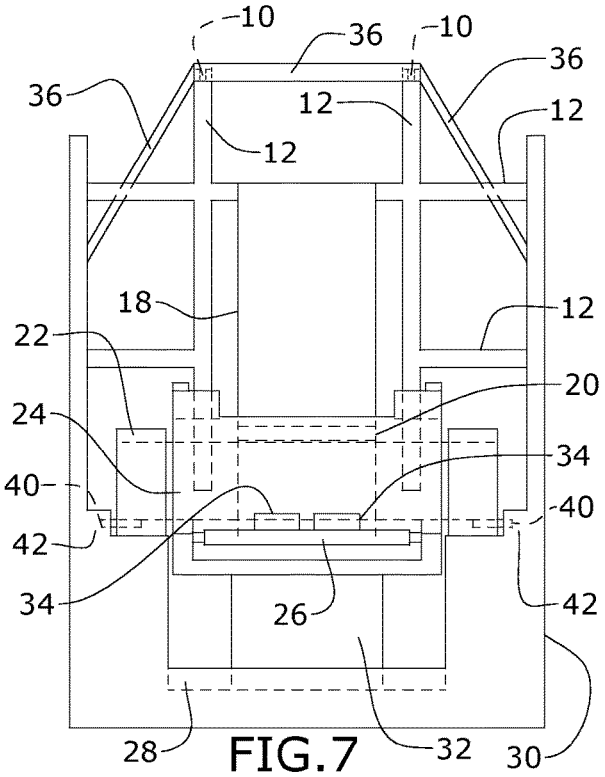
FIG. 7 is a front view of an embodiment of the present invention.
Figure 8:
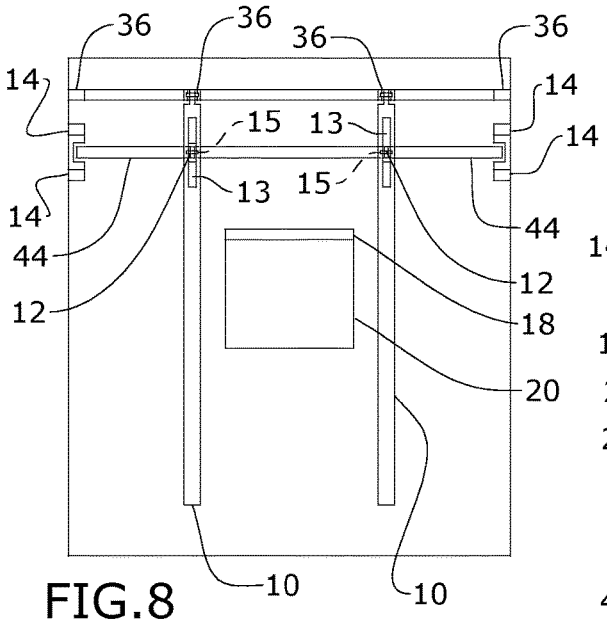
FIG. 8 is a top view of an embodiment of the present invention.
Figure 9:
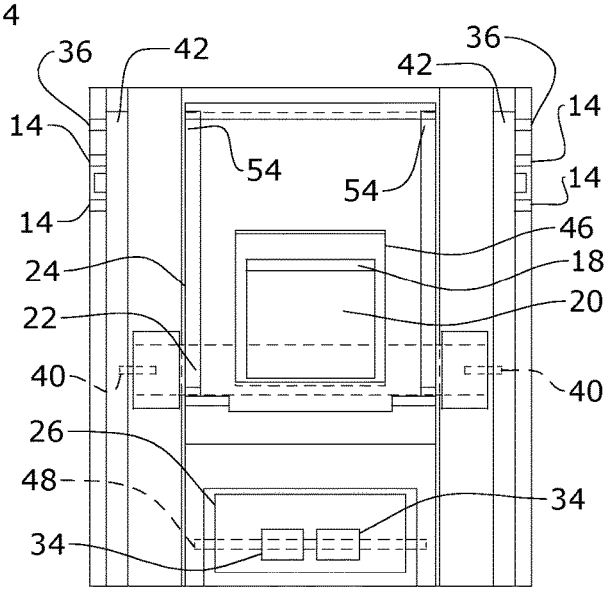
FIG. 9 is a top view of an embodiment of the present invention.
Figure 10:
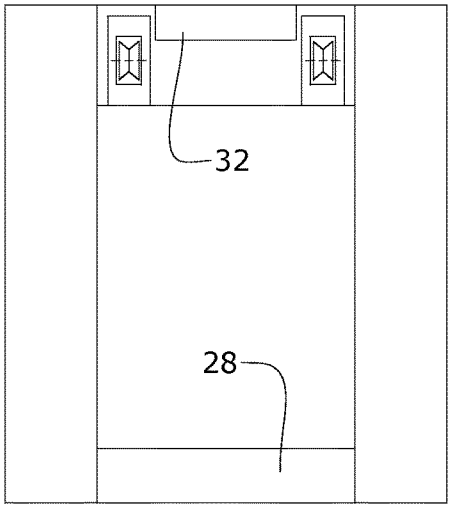
FIG. 10 is a top view of an embodiment of the present invention.
Figure 11:
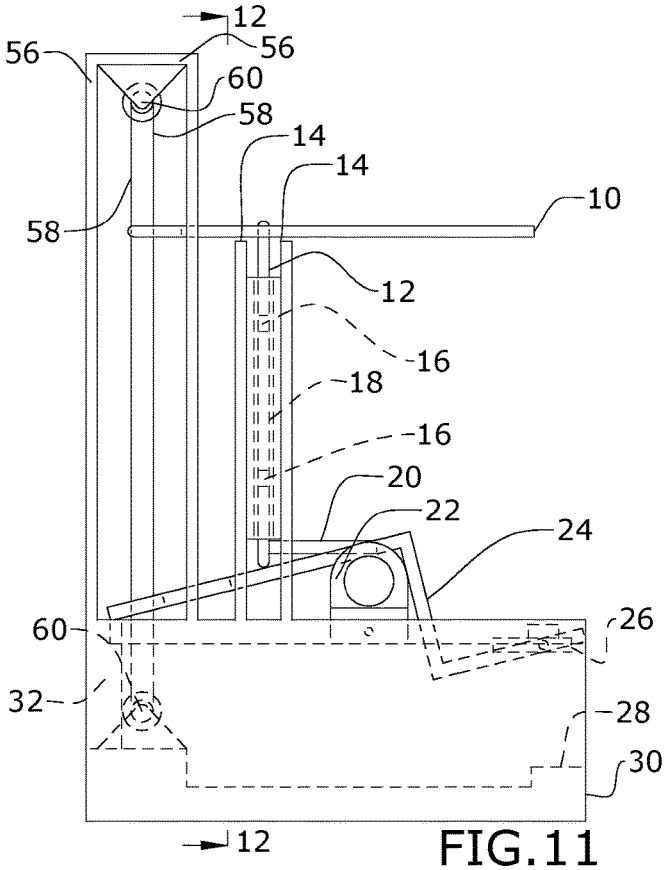
FIG. 11 is a side view of an embodiment of the present invention.
Figure 12:
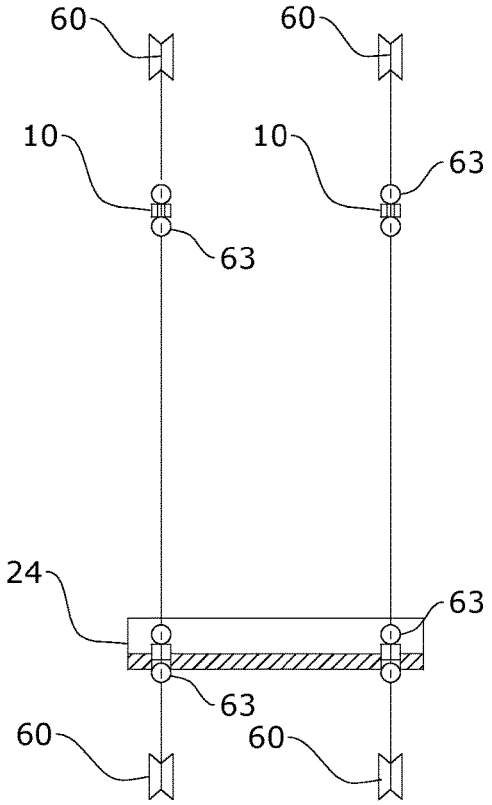
FIG. 12 is a section detail view taken along line 12-12 of FIG. 11.
Figure 14:
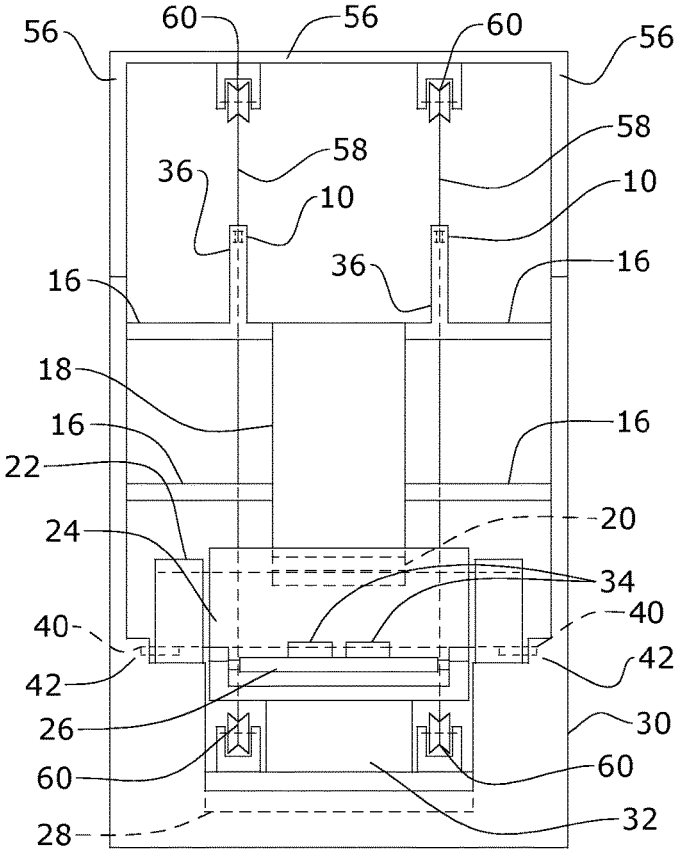
FIG. 14 is a front view of an embodiment of the present invention.
Figure 13:
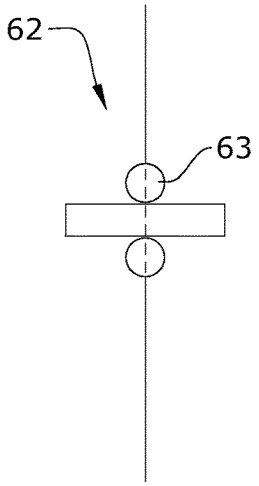
FIG. 13 is a detail side view of an embodiment of the present invention.
Figure 15:
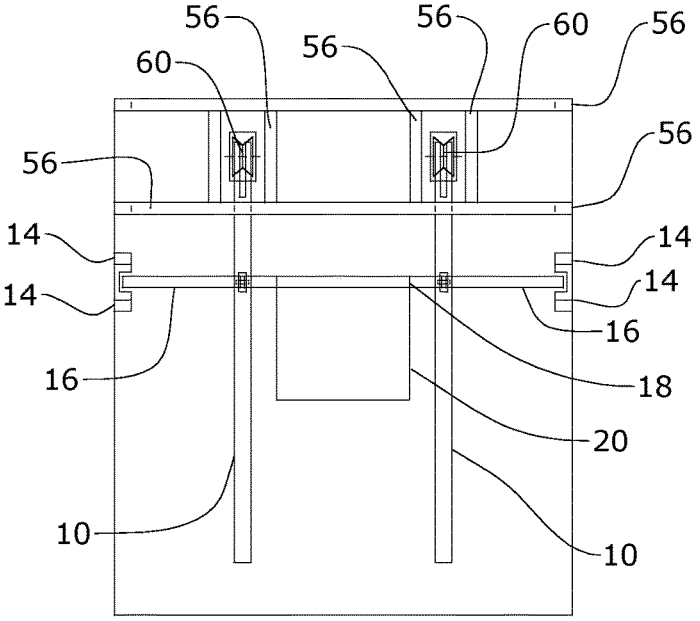
FIG. 15 is a top view of an embodiment of the present invention.
Figure 16:
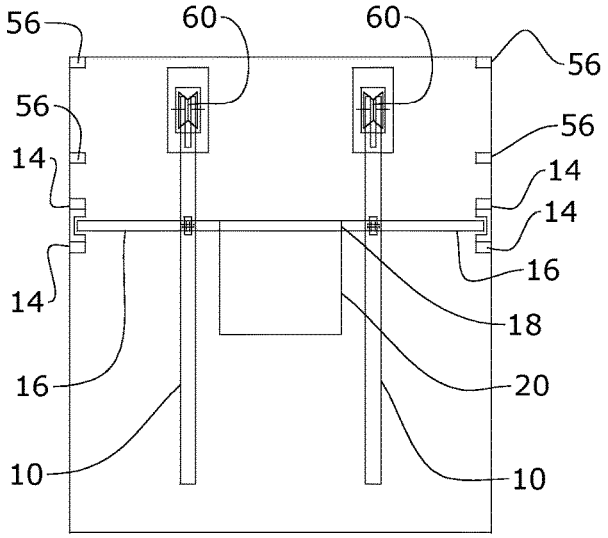
FIG. 16 is a top view of an embodiment of the present invention.

The following detailed description is of the best currently contemplated modes of carrying out exemplary embodiments of the invention. The description is not to be taken in a limiting sense, but is made merely for the purpose of illustrating the general principles of the invention.

Referring to FIGS. 1 through 30, the present invention includes an exercise machine with a base 30. The base 30 may include a pair of spaced apart upright walls extending vertically from a bottom. Each of the upright walls may include a track 42 formed along an inner surface, near a top end. A back wall 32 may protrude vertically from a back end of the bottom. A front wall 28 may protrude vertically from a front end of the bottom. Protruding from the rear of the base 30 may be an anchor bar 36. The anchor bar 36 may be substantially perpendicular to the base 30. An overhead handle bar 10 may be pivotally connected to the top of the anchor bar 36.

The present invention may further include a fulcrum 22. As illustrated in FIGS. 23 through 26, the fulcrum 22 may include a frame 70 having laterally extending guide bearings 40 slidably engaged within the tracks 42. The fulcrum 22 may further include a rotating cylinder 72 rotatably disposed within the frame 70. The rotating cylinder 72 may rotate relative to the frame 70 along the rotating cylinder's longitudinal axis. In alternate embodiments, the present invention includes a front rolling cylinder stop 82*a* at the front of the base 30 and a rear rolling cylinder stop 82*b* at the rear of the base 30. In such embodiments, the fulcrum 22 is a rolling cylinder 78. The rolling cylinder 78 may roll in between the front rolling cylinder stop 82*a* and the rear rolling cylinder stop 82*b*.

The present invention may further include a slant board 24. The slant board 24 may be located substantially above the base 30. The slant board 24 rests on top of the rotating cylinder 72 of the fulcrum 22. The slant board 24 includes a horizontal back portion, a vertical middle portion, and a horizontal front portion. The horizontal back portion of the slant board 24 may rest on the rotating cylinder 72, adjacent to the vertical middle portion. The horizontal back portion may further include an opening 46 in which a seat 20 is disposed within. A footpad 26 may be attached to the horizontal front portion of the slant board 24. The footpad 26 may connect to the slant board 24 by a rotating dowel 48 and thereby the footpad 26 may pivot relative to the slant board 24. A pair of foot straps 34 may be attached to an upper surface of the footpad 26.

Figure 27:
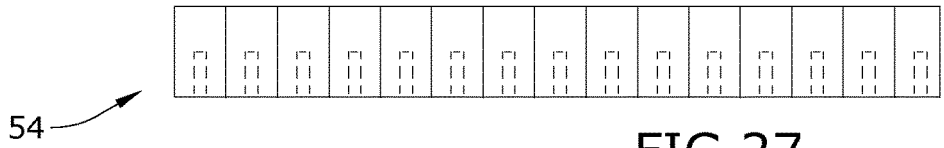
FIG. 27 is a side view of an embodiment of the present invention.
Figure 28:
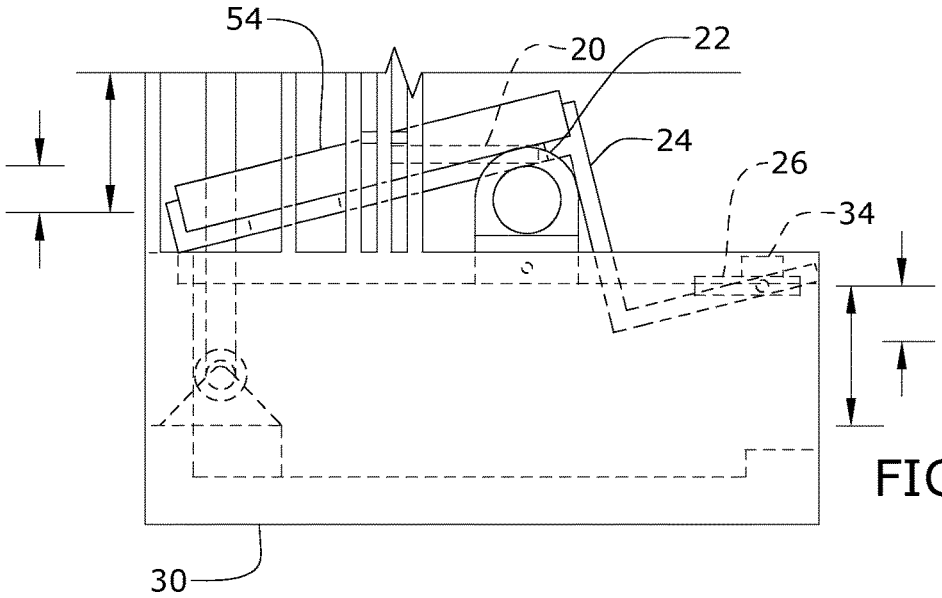
FIG. 28 is a side detail view of an embodiment of the present invention.
Figure 29:
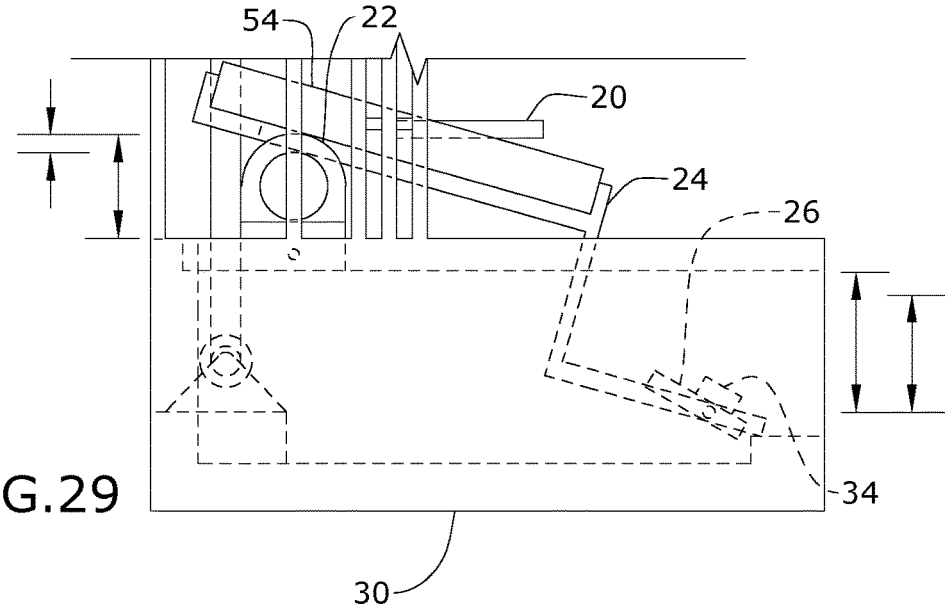
FIG. 29 is a side detail view of an embodiment of the present invention.
Figure 30:
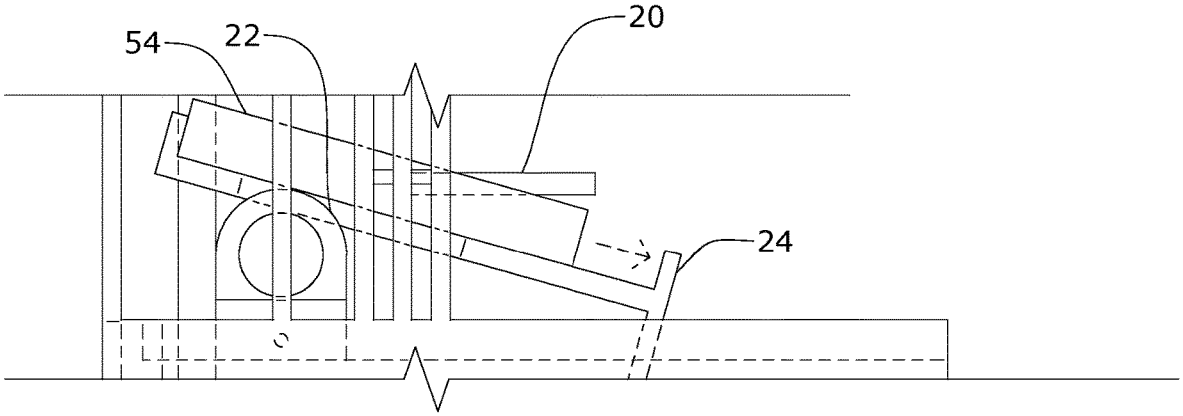
FIG. 30 is a side detail view of an embodiment of the present invention.

In certain embodiments, a weight 54 may be added to the horizontal back portion to add resistance when the user's weight is not used for resistance. As illustrated in FIG. 27, the weight 54 may include a plurality of weights. In such embodiments, the horizontal back portion of the slant board 24 includes a plurality of pegs extending vertically from an upper surface. Each of the plurality of weights may include an opening that fits around the pegs. Therefore, the user may remove and add weights to the slant board 24 depending on amount of resistance desired. As illustrated in FIG. 30, the weight 54 may slide from a rear end of the slant board 24 to a front end of the slant board 24 while in use.

In certain embodiments, a seat back 18 may be connected to the exercise machine. For example, as illustrated in the Figures, the seat back 18 may be connected to the base 30 and slide within the vertical guide rails 14. The seat 20 protrudes horizontally from the seat back 18. Behind the seat back 18 and attached to the slant board 24 may be connecting bars 12. The connecting bars 12 may each include a sliding pin 15 disposed within a slot 13 formed in the slant board 20. The sliding pins 15 slide along the slot 13. The connecting bars 12 protrude upwards from the slant board 24 and pivotally connect to the overhead handle bars 10. For example, the connecting bars 12 may each include a sliding pin 15 disposed within a slot 13 formed in the overhead handle bar 10. The sliding pins 15 slide along the slot 13.

As mentioned above, the present invention may include vertical guide rails 14. The vertical guide rails 14 extend vertically from the top of the base 30. A first set of vertical guide rails 14 may include aligned slots. The seat back 18 is slidably connected to the vertical guide rails 14 by connecting members 16 disposed within the aligned slots. A second set of vertical guide rails 14 may also include aligned slots. The connecting bars 12 are slidably connected to the vertical guide rails 14 by connecting members 44 disposed within the aligned slots.

To use the present invention, the user may sit on the seat 20. The user may secure their feet to the footpad 26 using the foot straps 34. When the fulcrum 22 is near the front of the base 30, the user may press the front of the slant board 24 downwards with their feet. This may thereby force the fulcrum 22 to slide backwards along the track 42 or roll. At this point, the slant board 24 may be slanting downwards, and front of the slant board 24 may rest against the front wall 28. The user may then lift the front of the slant board 24 using the foot straps 34 when the fulcrum 22 is disposed at the rear of the base 30. By lifting upward, the fulcrum 22 is forced to slide or roll forwards to the front of the base 30. The overhead handle bar 10 may also be used as a mechanism to move the fulcrum 22 forward and backward along the base 30. For example, the overhead handle bar 10 may be pushed upward, thereby pushing the rear of the slant board 24 downward and positioning the slant board 24 towards the upward slanting position. Further, the overhead handle bar 10 may pulled downward, lifting the rear of the slant board 24 and positioning the slant board 24 towards the downward slanting position.

Referring to FIGS. 10 through 22, the present invention may include a pulley system. A pulley support 56 protrudes vertically from the rear of the base 30. The pulley support 56 may be substantially perpendicular to the base 30. The pulley support 56 may support pulleys 60, such as upper pulleys 60*a* and lower pulleys 60*b*. Pulley cables 58 may wrap around the pulleys 60. A pulley connection 62 may be between the pulley cables 58 and the overhead handle bar 10 and the pulley cables 58 and the slant board 24. The pulley connection 62 may include rounded pegs 63. The pegs 63 may be coupled to the pulley cables 58. The pegs 63 may be disposed above and below the overhead handle bar 10 and the slant board 24. Therefore, when either the overhead handle bar 10 or the slant board 24 is pivoted, the pulley cables 58 are moved upward or downward in the same direction as the overhead handle bar 10 and the slant board 24.

Alternatively, the present invention may include two bars that connect to the pulley cables 58 and move in the same direction. One bar runs through a slot in the slant board 24, and the other through a slot in each overhead handle bar 10. To reduce friction, the bars could pivot within a slidable piece within the slots. The pivot-slide assembly could be coupled to the connecting bars 12, the slant board 24, and the overhead handle bars 10.

Figure 18:
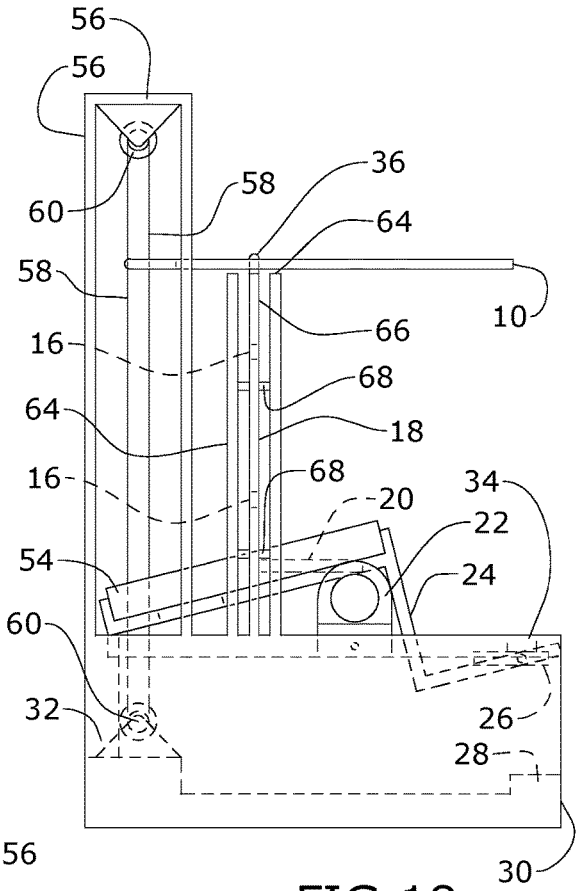
FIG. 18 is a side view of an embodiment of the present invention.
Figure 17:
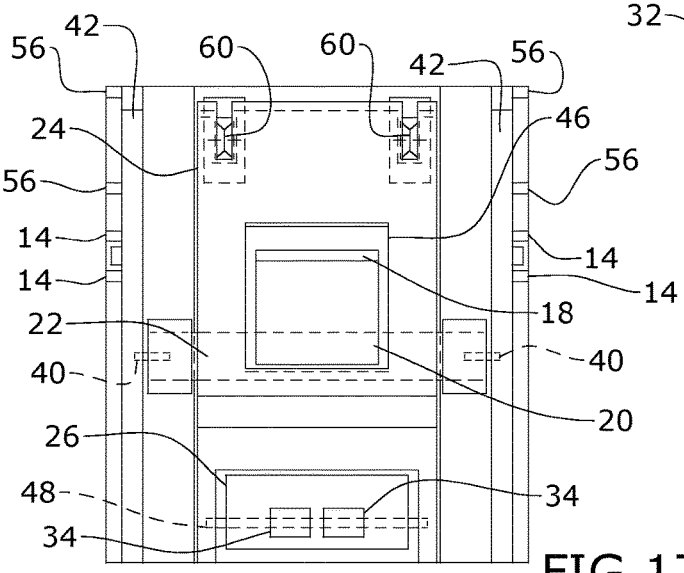
FIG. 17 is a top view of an embodiment of the present invention.
Figure 19:
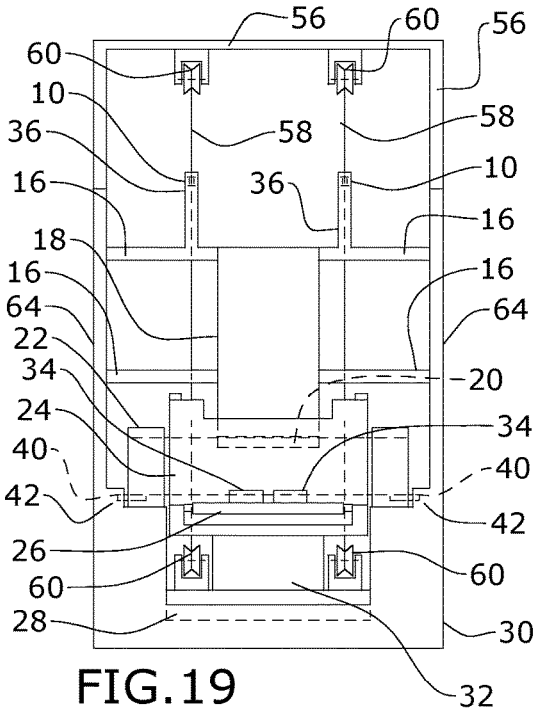
FIG. 19 is a front view of an embodiment of the present invention.
Figure 20:
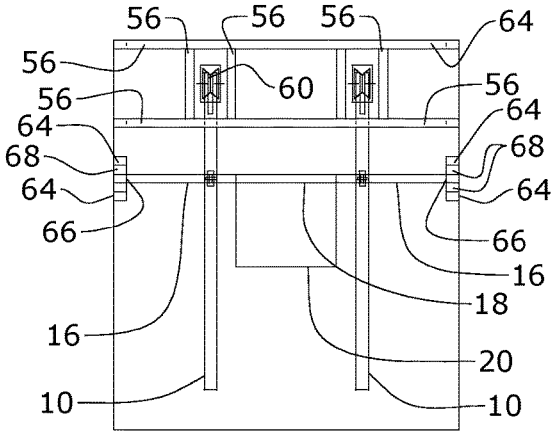
FIG. 20 is a top view of an embodiment of the present invention.
Figure 21:
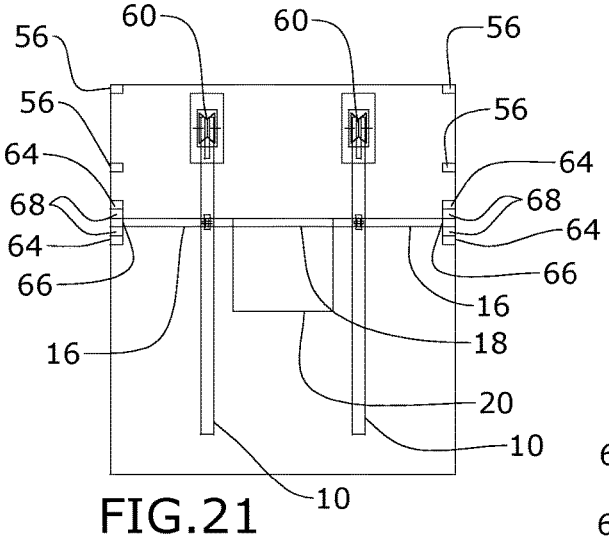
FIG. 21 is a top view of an embodiment of the present invention.
Figure 22:
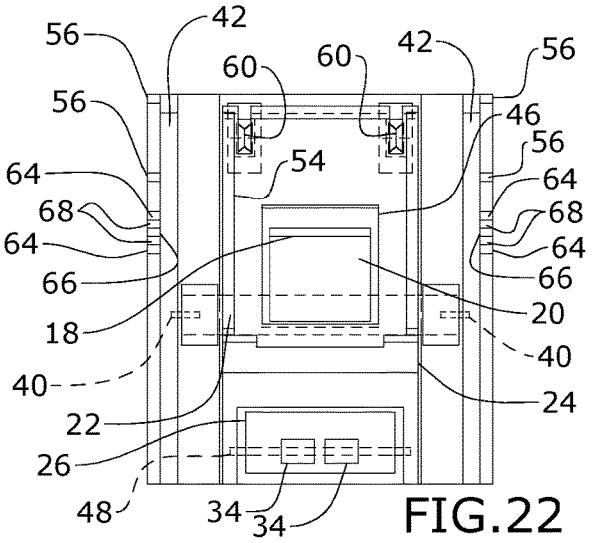
FIG. 22 is a top view of an embodiment of the present invention.
Figure 23:
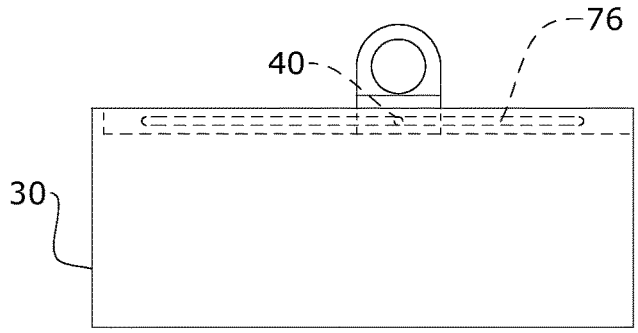
FIG. 23 is a front view of an embodiment of the present invention.
Figure 24:
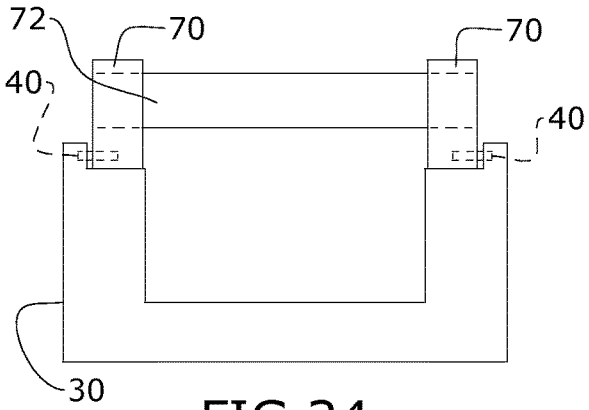
FIG. 24 is a side view of an embodiment of the present invention.
Figure 25:
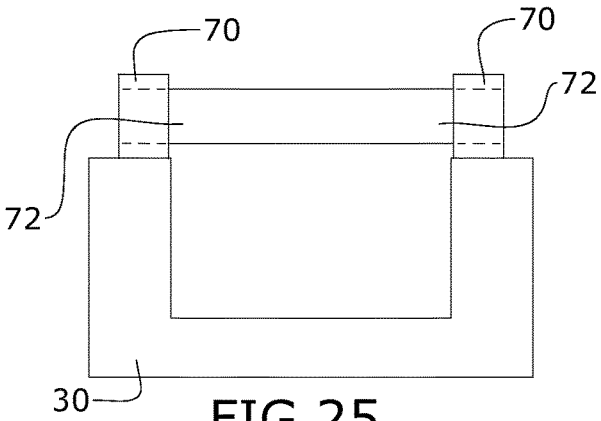
FIG. 25 is a front view of an embodiment of the present invention.
Figure 26:
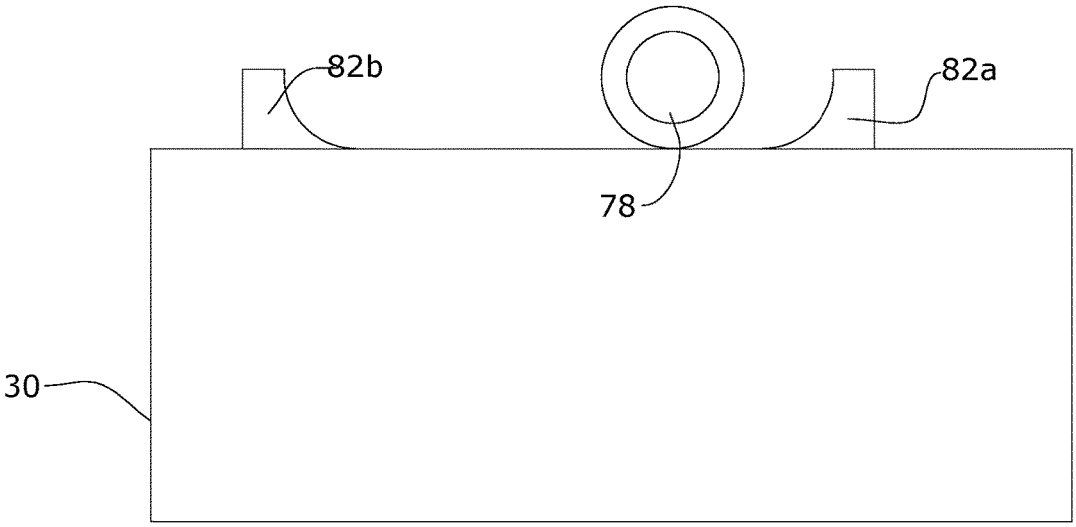
FIG. 26 is a side view of an embodiment of the present invention.

As illustrated in FIG. 18, the seat back 66 may be stationary relative to the base 30. In such embodiments, the seat back 66 is fixed and extending upward from the base 30. Additional support posts 64 may also be fixed to and extending upward from the base 30. The support posts 64 may surround the seat back 66. Bracings 68 may extend laterally from the support posts 64 and couple the support posts 64 to the seat back 66, further stabilizing the seat back 66. In such embodiments, the over head bars 10 may pivot relative to the seat back 66 and may push the pulley cord 58 upwards and downwards.

It should be understood, of course, that the foregoing relates to exemplary embodiments of the invention and that modifications may be made without departing from the spirit and scope of the invention as set forth in the following claims.

What is claimed is:

1. An exercise machine comprising:

a base comprising upright walls spaced apart from one another, and tracks formed along inner surfaces of the upright walls from a front end of the base to a rear end of the base;

a fulcrum comprising a frame and a rotating cylinder rotatably disposed within the frame, wherein guide bearings extend from opposing sides of the frame and are slidably disposed within the tracks;

a slant board disposed substantially above the base and resting on the rotating cylinder;

a seat back extending vertically from the base and comprising a seat; and an overhead handle bar disposed above the seat.

2. The exercise machine of claim 1, wherein the slant board comprises a horizontal back portion, a vertical middle portion, and a horizontal front portion.

3. The exercise machine of claim 2, further comprising a weight disposed on the horizontal back portion.

4. The exercise machine of claim 1, wherein the base further comprises a back wall and a front wall disposed to prevent the slant board from pivoting forward or backward beyond the front wall and the back wall respectively.

5. The exercise machine of claim 1, further comprising an anchor bar protruding from the rear end of the base and pivotally attached to the overhead handle bar.

6. The exercise machine of claim 1, further comprising a connecting bar connected to the rear end of the slant board, a sliding pin disposed within a slot and pivotally connected to the overhead handle bar.

7. The exercise machine of claim 1, further comprising a footpad pivotally attached to the front end of the slant board.

8. The exercise machine of claim 7, further comprising foot straps attached to the footpad.

9. An exercise machine comprising:

a base comprising a front end, a rear end, and upright walls;

a rotating cylinder rotatably disposed on the upright walls and operable to rotate from the rear end of the base to the front end of the base and from the front end of the base to the rear end of the base;

a slant board disposed substantially above the base and resting on the rotating cylinder, the slant board comprising a horizontal back portion, a vertical middle portion, and a horizontal front portion; and a seat back extending vertically from the base and comprising a seat.

10. The exercise machine of claim 9, further comprising an overhead handle bar disposed above the seat back.

11. The exercise machine of claim 10, further comprising an anchor bar protruding from the rear end of the base and pivotally attached to the overhead handle bar.

12. The exercise machine of claim 10, further comprising a connecting bar connected to the rear of the slant board, a sliding pin disposed within a slot and pivotally connected to the overhead handle bar.

13. The exercise machine of claim 9, further comprising a footpad pivotally attached to the front end of the slant board.

14. The exercise machine of claim 13, further comprising foot straps attached to the footpad.

15. The exercise machine of claim 9, wherein the base further comprises a back wall and a front wall disposed to prevent the slant board from pivoting forward or backward beyond the front wall and the back wall respectively.

* * * * *